United States Patent [19]

Lagal

[11] 4,162,969

[45] Jul. 31, 1979

[54] APPARATUS FOR SEPARATING MATERIAL BY SPECIFIC GRAVITY

[75] Inventor: Roy Lagal, 2416½ E. Main, Lewiston, Id. 83501

[73] Assignee: Roy Lagal, Lewiston, Id.

[21] Appl. No.: 813,957

[22] Filed: Jul. 8, 1977

[51] Int. Cl.[2] ..... B03B 5/02

[52] U.S. Cl. ..... 209/447; 209/506

[58] Field of Search ..... 209/447, 506, 422, 446

[56] References Cited

U.S. PATENT DOCUMENTS

| | | | |
|---|---|---|---|
| 646,382 | 3/1900 | Collins | 209/447 |
| 1,534,224 | 4/1925 | Leahy | 209/506 |
| 1,966,359 | 7/1934 | Ryan | 209/447 |
| 1,972,645 | 9/1934 | Danills | 209/447 |

*Primary Examiner*—Ralph J. Hill

*Attorney, Agent, or Firm*—Richards, Harris & Medlock

[57] ABSTRACT

A device for separating particles of relatively high specific gravity from particles of relatively low specific gravity wherein the particles to be separated are suspended in a carrier fluid is provided. The device includes a truncated conical shaped surface extending outward from a flat circular bottom surface, the angle of incline of such conical shaped surface being such as to allow the carrier fluid to be swirled easily within the device without excess spillage. The truncated conical shaped surface of the device also includes stepped indentations for up to about one third of the circumference of the conical surface. Each of the stepped indentations include a first surface which is substantially perpendicular to the conical surface and a second surface joined to the first surface at an angle of 90° and extending from the point of juncture with the first surface to points lying in the plane of the conical surface.

10 Claims, 4 Drawing Figures

APPARATUS FOR SEPARATING MATERIAL BY SPECIFIC GRAVITY

BACKGROUND OF THE INVENTION

This invention relates to devices for separating particulate materials of varying specific gravities. In another aspect, this invention relates to a device for separating particles of relatively high specific gravity from particles of relatively low specific gravity wherein both kinds of particles are carried in temporary suspension by a fluid. In still another aspect, this invention relates to a device for separating particulate materials of varying specific gravity which includes a truncated conical surface having a series of concentric stepped indentations wherein each of the indentations includes two surfaces joined at a 90° angle.

It is a well known principle that particulate matter of varying specific gravity may be separated by placing the particulate materials is a carrier fluid and thereafter creating a permanent or temporary suspension. Depending upon the carrier fluid employed and the degree of variance of the specific gravities of the particulate materials to be separated, separation can be effected in various manners. For example, it is sometimes possible to employ a carrying fluid having a specific gravity greater than that of a portion of the particulate matter to be separated and less than that of another portion of the particulate matter. In these cases, separation can be effected relatively easily since the particulate matter of lower specific gravity simply floats on the surface of the carrying fluid and can be skimmed off. In other instances, it is impractical to use such a carrier fluid and therefore an inexpensive and readily available carrying fluid is employed even though all of the particulate materials which are to be separated have specific gravities greater than the carrying fluid. In these cases separation can be effected by imparting motion to the carrying fluid in order to temporarily suspend those portions of the particulate matter which have a relatively low specific gravity. Separation can then be effected by separating the fluid medium with the suspended particles of relatively low specific gravity from the particles of relatively high specific gravity which were not carried into suspension by the motion imparted to the carrier fluid.

A well known application of this latter method of separation is the practice of panning for gold. It was discovered very early that particles of gold could often be found mixed with the sand and other particulate material found in stream and river beds. Early prospectors utilized the above discussed principles of separation by specific gravity to separate the valuable gold particles from the sand, mud and other materials found in the stream bed. Because water was readily available as the carrier fluid, the separation process was effected by simply placing particulate matter from the stream bed in a container along with a sufficient amount of water and imparting motion to the water to thereby suspend the particles of relatively low specific gravity and separate them from gold particles which have a relatively high specific gravity. Gold has a specific gravity in the range of from about 16 to about 18 grams per cubic centimeter while sand normally has a specific gravity of 2.5 grams per cubic centimeter. This wide discrepancy in specific gravities made it possible to separate the gold particles from sand and other particulate matter by swirling the mixture in a simple pan device and pouring the water and suspended sand particles out of the pan leaving the high density gold particles behind.

This method of gold recovery has some inherent disadvantages. For example, when the gold particles are of relatively low particle sizes, they sometimes will follow the sand and other particulate matter into suspension upon swirling in a pan type device. When this occurs, pouring of the suspended materials out of the gold pan will result in a loss of these fine particles of gold. Such losses of finely divided gold particles have heretofore been unavoidable because of the inaccuracies and human error which are inherent in the panning of gold by hand. The amount of swirling motion imparted to the water is incapable of being finely adjusted so as not to cause gold particles of small particle size to be placed in suspension when it is performed by hand. Furthermore, the water carrying the suspended particles must be poured out of the pan at a rate sufficient to keep the suspended particles from falling out of suspension and becoming recombined with the gold particles in the bottom of the pan. Thus, the rates of swirling and pouring are subject to the inaccuracies of human judgment and present a problem in the recovery of gold particles of relatively small particle sizes. A device which is capable of use in this relatively simple method of gold recovery, but which aids in the recovery of gold particles of relatively small particle size is therefore desirable.

SUMMARY OF THE INVENTION

The device of the present invention overcomes the difficulties described above and can be employed to improve the recovery of finely divided particles of gold which are unrecoverable when common gold pans are employed. In addition, the device of the subject invention may be successfully employed to separate any particulate matter of varying specific gravities which is to be separated by creating a temporary or permanent suspension of the particulate material in a carrier fluid.

The device of the present invention can be generally described as pan shaped and includes a flat circular bottom surface from which a truncated conical surface extends outwardly. The truncated conical surface of the device aids in the swirling motion which is imparted to the particulate matter which is to be separated. It has been discovered that when stepped indentations extending for up to about one third of the circumference of the truncated conical surface of the device are employed, improved separation can be effected. Basically, the stepped indentations act to entrain those portions of particulate matter of relatively high specific gravity which have become temporarily suspended in the carrier fluid. These suspended particles of higher specific gravity will normally be suspended only a short distance above the surface of the device compared to the suspended particles of relatively low specific gravity. Thus, when the carrier fluid is poured out of the device, and passes over the stepped indentations provided therein, the particles of higher specific gravity will be caught and entrained by the surfaces of the stepped indentations which are substantially perpendicular to the truncated conical surface. Additionally, it has been discovered that these stepped indentations, sometimes referred to as "riffles" perform their function most efficiently when the two surfaces of the indentation are joined at a 90° angle and a typical radius of zero. The phrase "typical radius of zero" as used herein refers to a sharp, right angled, juncture between the two surfaces of each stepped indentation as opposed to a slightly curved juncture wherein the radius of the curvature is measurable.

DETAILED DESCRIPTION OF THE INVENTION

Figure 1:
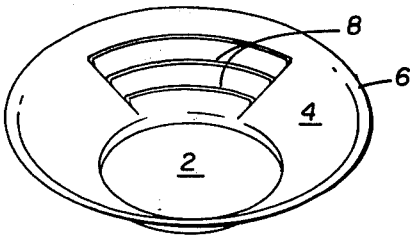
FIG. 1 depicts a perspective view of the device of the present invention.
Figure 4:
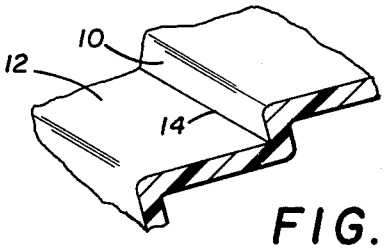
FIG. 4 is an enlarged fragmentary perspective view of the stepped indentations of the device of the present invention.
Figure 2:
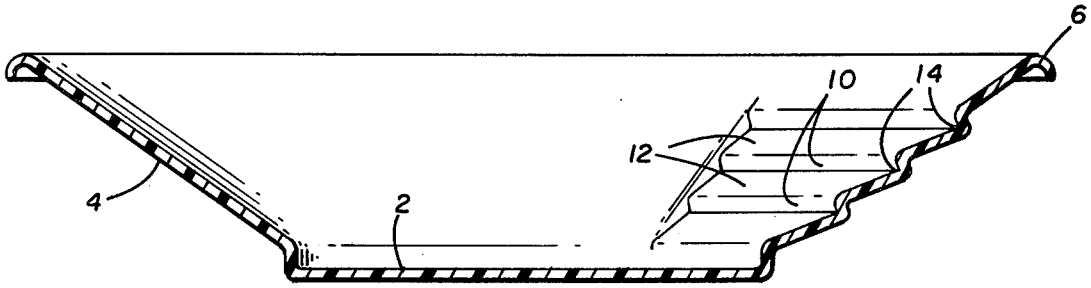
FIG. 2 depicts a cross sectional view of the device of the present invention.

The device of the present invention can be better understood by reference to the drawings. The present invention is in no way limited by the embodiment depicted in the drawings and modifications and variations of the device of this invention will be apparent to one skilled in the art.

Generally, the device of the present invention can include a flat circular bottom surface 2 upon which the particulate matter to be separated may be placed. The circular bottom surface will normally be flat in order that the device may rest easily on a flat surface but may be slightly concave or convex and non-flat bottom surfaces will not substantially impair the operation of the device. A truncated conical surface 4 extends outward from the flat bottom surface 2. The angle of incline of the truncated conical surface with respect to the bottom surface of the device can be any angle which allows carrier fluid contained within the device to be swirled easily when a gentle rotative motion is imparted to the device. Thus, factors considered in setting the angle of incline of the truncated conical surface include the ease with which the carrier fluid may be swirled balanced against the spillage which may occur should the angle not be great enough. Generally, the angle of incline can be from about 30° to about 40° and an angle of about 35° is preferred. The outermost edge of truncated conical surface 4 may be rolled under to form a lip 6 which facilitates easier pouring and provides an excellent surface for grasping the device.

An important aspect of the subject device relates to the stepped indentations, or riffles, which are provided along a portion of the truncated conical surface 4. These stepped indentations represented collectively by the number 8 (FIG. 1) may extend for the entire circumference of the truncated conical surface 4. However, in most cases, it is sufficient that the stepped indentations 8 extend for about one third of the circumference of the truncated conical surface 4. It should be noted, that because of the conical shape of the surface in which they are formed, the stepped indentation closest to the edge or lip 6 of truncated conical surface 4 will be longer physically than will be the stepped indentation located closest to the bottom surface 2. Normally, at least two or more of the stepped indentations 8 are formed in truncated concial surface 4. The preferred number of such stepped indentations 8 is three.

These stepped indentations 8 or riffles of the present invention can be generally described as follows. Each of said stepped indentations includes a first surface 10 which is substantially perpendicular to the trunkated conicle surface 4. A second surface 12 is joined to each of these first surfaces 10 of each stepped indentation at a 90° angle. The second surface 12 then extends from the point of juncture with the first surface 10 to points lying in the plane of the truncated conical surface where the second surface 12 forms a juncture with the first surface 10 of the next succeeding stepped indentation. It has been discovered that for optimum results, the angle of juncture 14 between the first surface 10 and the second surface 12 of each of the stepped indentations must be as close to 90° as is practicably possible to obtain in terms of manufacturing techniques. For example, it has been determined that when the angle between the first surface 10 and second surface 12 is from 80° to 85° operation of the device is substantially impaired. It is also important that the juncture 14 between first surface 10 and second surface 12 of each of the stepped indentations have a typical radius of approximately zero. That is, the juncture 14 between these two surfaces should be as sharp as possible as opposed to having a curve which is readily apparent to the eye. When the angle between first surface 10 and second surface 12 of each of the stepped indentations is kept at substantially 90° and the juncture 14 has a typical radius which approaches zero, particularly fine particles of gold, for example, can be separated employing the device of the subject invention.

Figure 3:
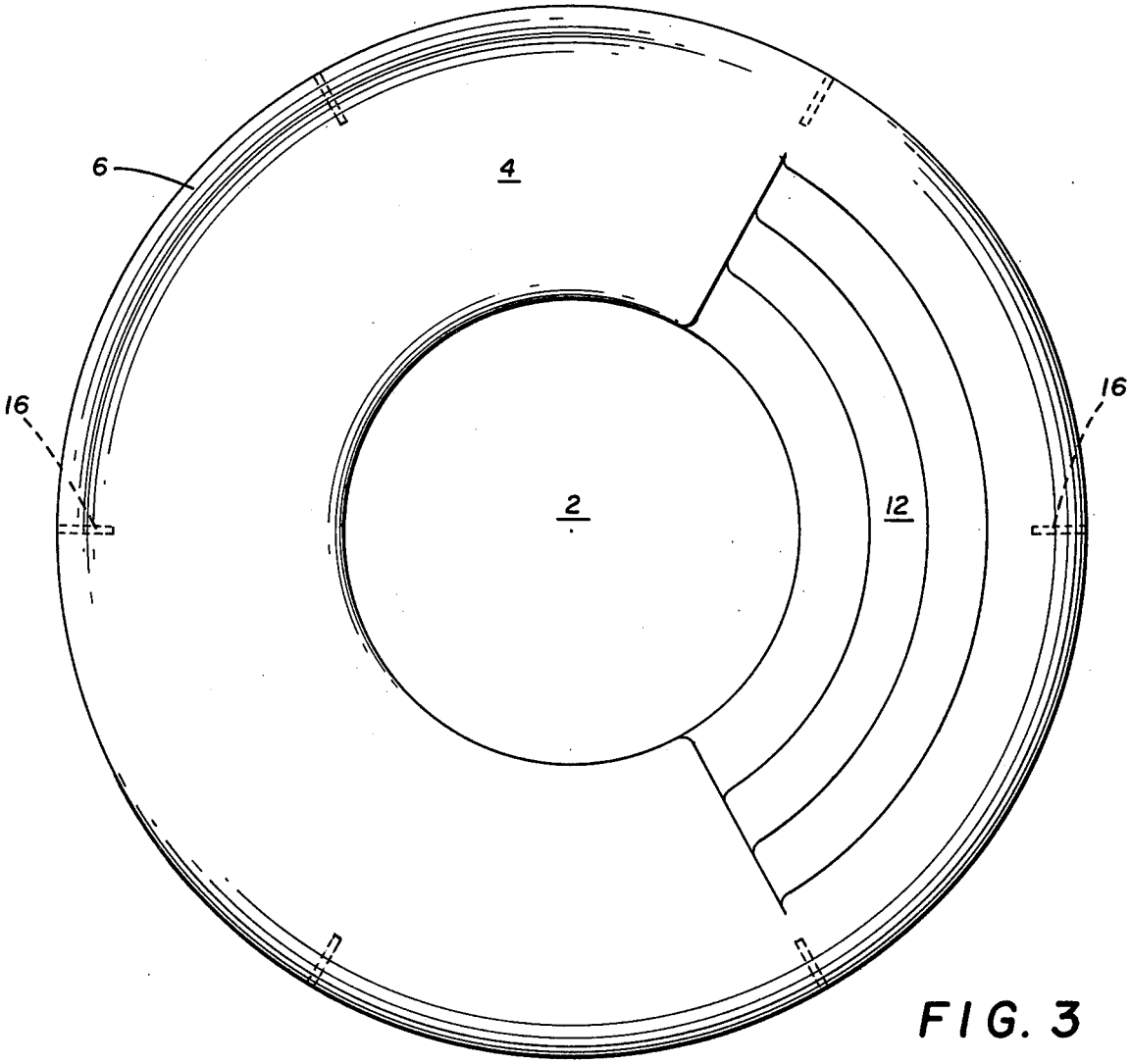
FIG. 3 depicts a top view of the device of the present invention.

The device described herein can be formed from any of a number of materials such as metal, ceramics or plastics. Moldable plastic compositions are preferred because of the ease of manufacturing which they provide. In particular, polyvinyl chloride is a preferred manufacturing material. When the device of the present invention is molded from plastic or other materials and lip 6 is formed around the uppermost outer edge of truncated conical surface 4, reinforcing ribs 16 (as depicted in FIG. 3) can be included to strengthen lip 6. When the device of the subject invention is to be employed in the panning of gold, it has been found that a dark green color aids in recovery of the gold. This is because gold is often found in combination with a blackish composition which shows up well against a green background and therefore aids the gold panner in his inspection of materials being panned.

The device of the present invention can be employed to separate particulate matter of varying specific gravity in the following manner. The particulate matter to be separated is placed by any convenient means into the device of the subject invention. A carrier fluid, such as water, is then added to the subject device. Alternatively, in cases like gold panning where the material to be separated is found in river or stream beds, the particulate material and carrier fluid may be introduced simultaneously to the device. Once the device contains the particulate matter to be separated and a suitable carrier fluid, a gentle rotative motion is imparted to the device to swirl the carrier fluid therewithin. The swirling action of the carrier fluid will cause portions of the particulate matter to go into suspension in the carrier fluid. The carrier fluid, with suspended particles is then poured out of the device in a manner such that the carrier fluid passes over the stepped indentations described in detail above. Particles of relatively low specific gravity which are in true suspension will flow easily out of the device with the carrier fluid. Heavier, finely divided particulate matter which is suspended only slightly in the carrier fluid will also begin to pass over the stepped indentations of the subject device. As these fine particles of relatively high specific gravity pass over the stepped indentations, they will contact at least one of the first surfaces 10 of the stepped indentations and be in entrained thereby. Thus, fine particles of relatively high specific gravity will tend to be separated out of the carrier fluid and be entrained by the first surface 10 (hereinbefore described in detail) of the stepped indentations of the subject device. In this manner, fine particles of relatively high specific gravity may be recovered and retained in the device even though they would have been poured out of the device along with the carrier fluid if they had been poured over a surface which did not contain the stepped indentations of the subject device.

Although preferred embodiments of the invention have been illustrated in the drawings, and described in the foregoing specification, it will be understood that the invention is not limited to the embodiments disclosed, but is capable of rearrangement, modification and substitution of parts and elements without departing from the spirit of the invention.

I claim:

1. A device for separating particles of relatively high specific gravity from particles of relatively low specific gravity wherein a carrier fluid is used to hold the particles in suspension during the separation process comprising, a truncated conical shaped surface extending outward from a flat circular bottom surface, the angle of incline of the conical shaped surface with respect to the bottom surface being sufficient to allow the carrier fluid to be swirled easily but without excess spillage and further comprising a plurality of concentric, stepped indentations extending for up to about one third of the circumference of the conical surface, the stepped indentations comprising a first surface, substantially perpendicular to the conical surface, and a second surface joined to the first surface at an angle of 90° and extending from the point of juncture of the first and second surfaces to points lying in the plane of the conical surface.

2. The device of claim 1 wherein the junctures formed by the first and second surfaces of the stepped indentations have a typical radius of substantially zero.

3. The device of claim 1 manufactured from a moldable plastic composition.

4. The device of claim 3 wherein the plastic composition is green in color.

5. The device of claim 4 wherein the plastic composition is polyvinyl chloride.

6. The device of claim 1 wherein the angle of incline of the conical shaped surface with respect to the bottom surface is from about 30° to about 40°.

7. The device of claim 1 wherein the number of concentric stepped indentations is three.

8. In an apparatus for separating, according to specific gravity, particulate matter which is carried by a fluid comprising a circular flat bottom surface, and a truncated conical surface extending outward therefrom, the improvement comprising concentric, stepped indentations extending for no more than about one third of the circumference of the conical surface, the stepped indentations comprising a first surface substantially perpendicular to the conical surface and a second surface joined to the first surface at an angle of 90° and extending from the point of juncture to points lying in the plane of the conical surface.

9. In an apparatus for separation according to specific gravity of particulate materials which are carried by a fluid comprising a circular flat bottom surface, a truncated conical surface extending outward therefrom and concentric stepped indentations comprising a first surface substantially perpendicular to the conical surface and a second surface joined to the first surface and extending from the point of juncture to points lying in the plane of the conical surface, the improvement comprising an angle of 90° between the first and second surfaces the point of juncture of such surfaces having a typical radius of substantially zero.

10. A device formed from a moldable thermoplastic composition which is used for separating particulate material of varying specific gravities wherein the particulate material is carried by a fluid, comprising a flat circular bottom plate, a truncated conical surface extending outward from the circular bottom plate at an angle of about 35°, three concentric stepped indentations in the conical surface, extending for up to about one third of the circumference of the conical surface, each of the stepped indentations comprising a first surface substantially perpendicular to the conical surface and a second surface joined to the first surface at an angle of 90° and extending from the juncture of the first and second surfaces to points lying in the plane of the conical surface, the juncture between the first and second surfaces, being substantially square.

* * * * *